United States Patent [19]

Kortmann

[11] Patent Number: 4,669,914

[45] Date of Patent: Jun. 2, 1987

[54] HYDROLOGIC DISCHARGE CONTROL ASSEMBLY AND METHOD

[76] Inventor: Robert W. Kortmann, 258 Richmond Rd., Coventry, Conn. 06238

[21] Appl. No.: 651,880

[22] Filed: Sep. 19, 1984

[51] Int. Cl.[4] ..... E02B 3/00

[52] U.S. Cl. ..... 405/52; 405/74; 405/88; 137/577

[58] Field of Search ..... 405/36, 37, 39, 40, 405/43–46, 52, 60, 63, 64, 77, 80, 87, 89, 91, 92, 104, 108, 73, 74, 88; 210/170; 137/236.1, 577, 577.5

[56] References Cited

U.S. PATENT DOCUMENTS

| | | | |
|---|---|---|---|
| 140,577 | 7/1973 | Comstock | 405/52 |
| 1,559,841 | 11/1925 | Benz | 405/52 |
| 3,235,234 | 2/1966 | Beaudoin | 405/52 X |
| 3,235,877 | 2/1966 | Grob | 405/52 X |
| 3,489,396 | 1/1970 | D'Aragon | 405/52 X |
| 3,701,260 | 10/1972 | Soileau | 405/88 X |
| 3,812,871 | 5/1974 | Miller | 405/52 X |
| 3,832,854 | 9/1974 | Metts | 405/74 |
| 3,854,291 | 12/1974 | Perkins | 405/108 |
| 3,984,987 | 10/1976 | Light, Jr. | 405/63 |
| 4,051,810 | 10/1977 | Breit | 405/52 X |
| 4,352,593 | 10/1982 | Iskra et al. | 405/80 X |

*Primary Examiner*—Cornelius J. Husar
*Assistant Examiner*—Nancy J. Stodola
*Attorney, Agent, or Firm*—Chilton, Alix & VanKirk

[57] ABSTRACT

A hydrologic discharge control assembly and method is disclosed for automatically withdrawing bottom water from a body of water comprising a housing for forming a reservoir to receive bottom water for automatic gravitational discharge relative to the height of the top surface of the body of water, the reservoir having a discharge overflow edge portion adapted for operational connection to the discharge drain passageway of the body of water and being disposed for overflow discharge of water within the reservoir in excess of a predetermined level, and an inlet connector fluidly connecting the housing to the bottom water portion of the body of water and being dimensioned and configured relative to the housing for conduction of bottom water into the reservoir relative to the height of the top surface of the body of water.

17 Claims, 8 Drawing Figures

HYDROLOGIC DISCHARGE CONTROL ASSEMBLY AND METHOD

BACKGROUND AND SUMMARY OF THE PRESENT INVENTION

This invention relates to the hydrologic control of lakes and ponds and more particularly to an apparatus and method for automatically controlled withdrawal of bottom water for controlling the growth of aquatic weeds and algae.

Lakes, ponds and other impoundments are frequently polluted by an excess growth of aquatic macrophytes, algae, and other microorganisms which create unacceptable water quality conditions for recreation, water supply, and wild life habitat during the growing season. As surface water becomes warm during the spring, the bottom water of a water body, such as a lake, becomes isolated from atmospheric gas exchange due to the differences in water density at different water temperatures. The desnity layers formed in the lake therefore result in different water quality between the surface water and the bottom water.

As organic materials decompose at the bottom of the lake, oxygen is consumed and carbon dioxide and nutrients are generated and released. The decomposition process results in the release of large amounts of phosphorus, nitrogen, carbon dioxide and other substances from the nutrient-rich sediments at the bottom of the lake and, during the growing season, the nutrients generated from the lake bottom contribute to the excessive growth of macrophytes and algae and the attendant unacceptable water conditions.

It is an object of the present invention to provide an apparatus and method for controlling aquatic macrophyte and algae growth by altering the outflow configuration of the water body for controlled discharge of bottom water as well as surface water.

Another object of the invention is to provide an apparatus and method for removing dense cool oxygen-deficient nutrient-rich bottom water from a water body at a rate which automatically adjusts to varying hydrologic conditions.

A further object of the invention is to provide an improved hydrologic discharge control assembly for the automatic withdrawal of bottom water without the need for pumping, siphoning, frequent adjustments, or large fluctuations in water level.

Yet another object of the invention is to provide a hydrologic discharge control assembly which achieves automatic bottom water withdrawal, adjustable surface-bottom water outflow ratios, and adequate flood storage while minimizing water body level fluctuations.

Other objects will be in part obvious and in part pointed out in detail hereinafter.

DESCRIPTION OF THE PREFERRED EMBODIMENT

Figure 1:
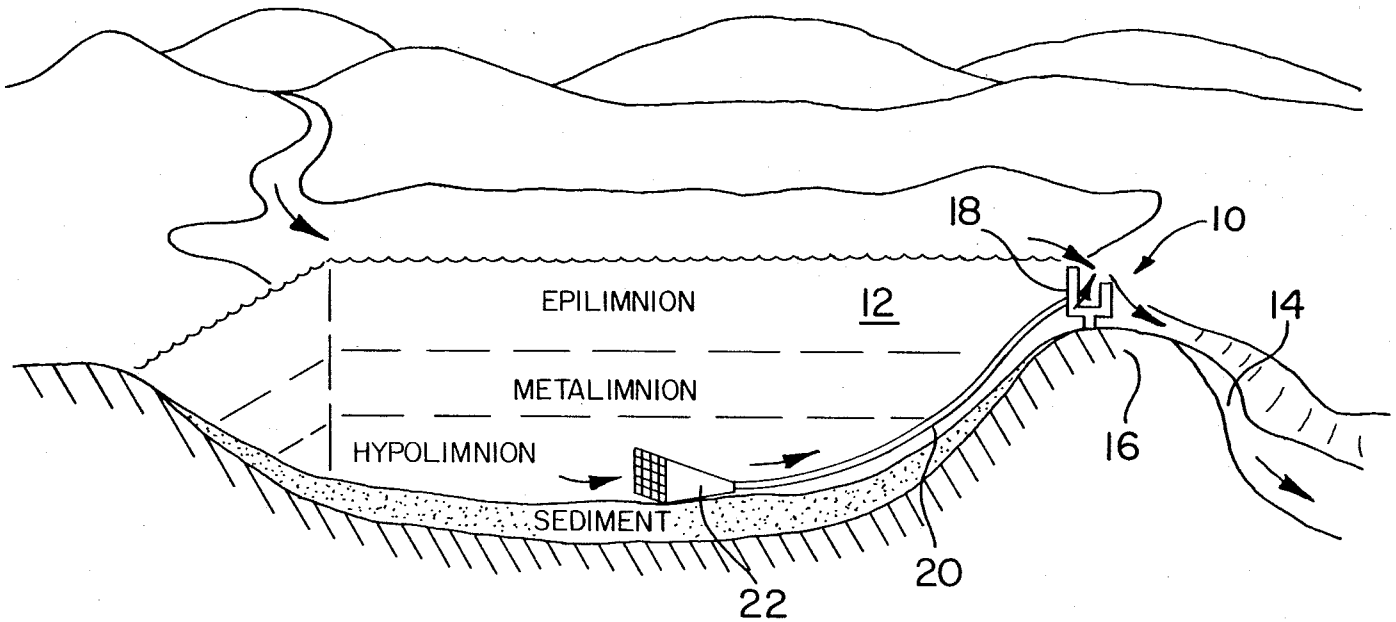
FIG. 1 is a diagrammatical view of the discharge control assembly of the present invention operationally mounted in a lake.
Figure 2:
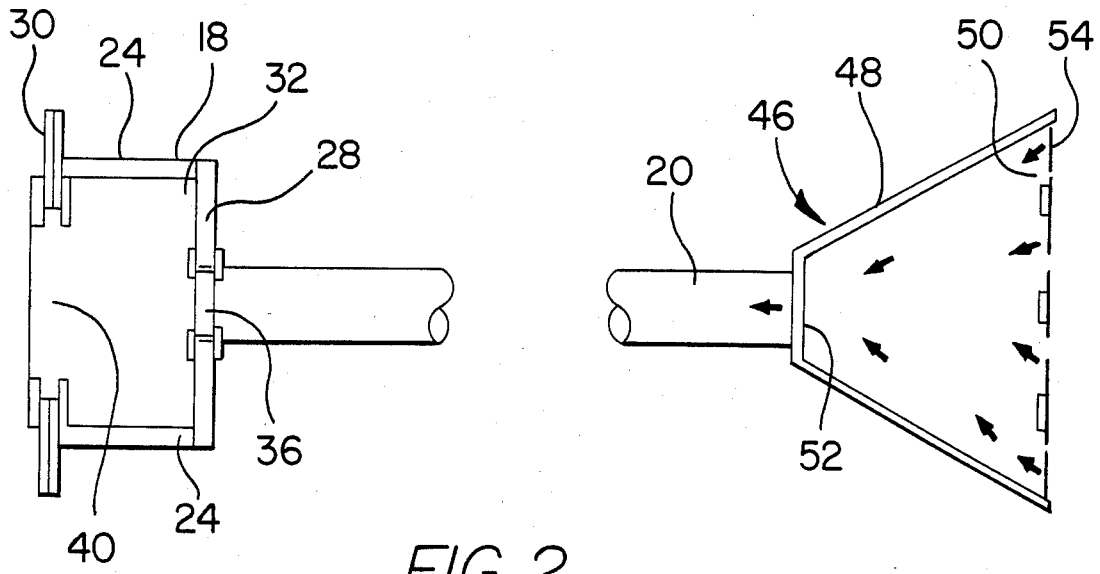
FIG. 2 is a diagrammatical sectional top view, partly broken away, of the bottom water collector and the flashboard box of the discharge control assembly of FIG. 1.

Referring to the drawings in detail wherein like numerals are used to designate the same or like parts, the hydrologic discharge control assembly of the present invention is generally designated by the numeral 10 and is shown in FIG. 1 operationally mounted within a landlocked water body or lake 12 with epilimnion, metalimnion and hypolimnion layers. The lake 12 is of the type adapted for lake-level control by a spillway system and has an outlet stream or discharge drain passageway 14 and an elevated side edge 16 adapted to support a flashboard system adjacent the outlet stream.

The discharge control assembly 10 includes a flashboard box 18 connected by a conduit 20 to a bottom water collector 22. The flashboard box 18 has opposing side walls 24, a bottom wall 26, a forward wall 28, and a rearward wall 30 together forming an interior reservoir or receptacle 32.

The forward wall 28 has an inlet port 34 connected to the bottom water conduit 20 to receive bottom water into the reservoir 32. The forward wall 28 also has a vertically extending inlet slot 36 for receiving surface water into the reservoir 32. An inlet flashboard wall assembly 38 controls the inflow of surface water through the slot 36 and includes a plurality of interlocking flashboard elements 39 detachably mountable within the inlet slot 36 for selective gradational closing off of the inlet slot 36 to control the inflow of surface water relative to the height of the lake and the height of the inlet wall assembly 38. Each flashboard element 39 is configured to slidably mount within the slot 36 and sealingly interlock with the forward wall 28 and adjacent upper and lower flashboard elements 39.

The rearward wall 30 has a vertically extending outlet slot 40 for discharging water out of the receptacle area 32. A discharge flashboard wall assembly 42 controls the discharge of water through the slot 40 and is comprised of a plurality of interlocking flashboard elements 44 detachably mountable within the discharge slot 40 for selective gradational closing off of the discharge slot 40 to control the discharge of water relative to the height of the water within the flashboard box 18 and the height of the discharge wall assembly 42. Each flashboard element 44 is configured to slidably mount within the slot 40 and sealingly interlock with the rearward wall 30 and adjacent upper and lower flashboard elements 44.

The flashboard box 18 is supported atop the elevated side 16 of the lake 12 so that the inlet slot 36 adjoins the body of water and the discharge slot 40 is positioned adjacent the discharge drain 14 so that water spilling outwardly through the discharge slot 40 and over the discharge flashboard wall assembly 42 flows into the drain 14.

Bottom water is received into the reservoir 32 through the conduit 20 and the bottom water collector 22. The bottom water collector 22 comprises a housing 46 having opposed inclined side walls 48, an inlet opening 50, and an opposed outlet port 52 connected to the conduit 20. The inlet opening 50 is dimensioned and configured to control the inflow velocity of bottom water into the collector 46 and is covered by a screen element 54. In water bodies which form an epilimnion, metalimnion and hypolimnion, such as the lake 12 illustrated in FIG. 1, it is preferred that the screened opening 50 be dimensioned and configured sufficiently to reduce the inflow velocity below 0.5 feet per second.

In shallow bodies of water which do not form a distinct epilimnion, metalimnion, hypolimnion, an alternate bottom water collector is preferred in order to distribute the withdrawal effects over a large bottom area of the water body. The alternate bottom water collector 56 comprises an elongated section of pipe 58 having a plurality of perforations or apertures 60 therein. Generally, the total area of the apertures should be sufficient to reduce the inflow velocity to less than 0.1 feet per second.

In operation, the discharge flashboard wall assembly 42 is assembled with a selected number of flashboard elements 44 so that the upper edge 45 of the uppermost flashboard element 44' forms a discharge overflow edge to define a predetermined spill-over level for the flashboard box. Similarly, the inlet flashboard wall assembly 38 is assembled with a selected number of flashboard elements 39 assembled to provide a predetermined inlet spill-over level as defined by the upper inlet overflow edge 37 of the uppermost flashboard element 39' of the inlet flashboard wall assembly 38. Both the predetermined discharge spill-over level 45 and the predetermined inlet spill-over level 37 are selectably variable by varying the respective heights of the discharge flashboard wall assembly 42 and the inlet flashboard wall assembly 38.

The pipe diameter of the conduit 20 is dimensioned for each individual body of water according to system hydrology, basin morphometry, rates of decomposition and nutrient release, and total available head. In general, the pipe diameter is of a size to accommodate the mean annual outflow from the particular body of water. The predetermined inlet spill-over level of the inlet flashboard wall assembly is always maintained at a level higher (or equal to) the predetermined discharge spill-over level of the discharge flashboard wall assembly, During summer operation, both levels are maintained at a higher elevation than during winter, spring, and fall operation in order to maintain a full body of water for the summer and allow for greater flood-water storage and flushing rate during fall, winter, and spring.

The withdrawal of bottom water from the lake into the flashboard box 18 for discharge is controlled by the effective head of the control assembly 10. The effective head H is determined by the vertical differential of the top surface of the lake 12 and the predetermined discharge spill-over level 45 of the discharge flashboard wall assembly 42. The effective head H increases automatically as the lake level rises and correspondingly causes the withdrawal of bottom water to increase automatically as the lake level rises. Consequently, a greater withdrawal rate is accomplished when additional water is available. The discharge of bottom water is a function of the length of the discharge overflow edge 45 and the depth of the water over said edge. The vertical differential d between the preset inlet overflow edge 37 and the discharge overflow edge 45 establishes the maximum bottom withdrawal rate relative to total outflow.

Figure 5:
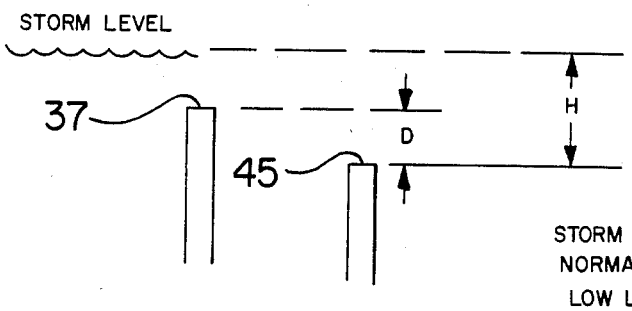
FIG. 5 is an enlarged schemtatic view of a portion of the flashboard box assembly of FIG. 3 with the lake level at a storm level condition.
Figure 6:
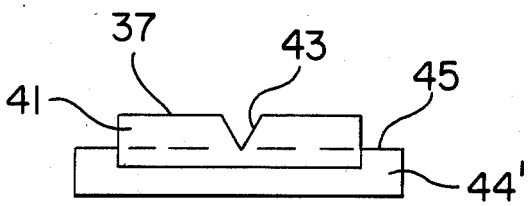
FIG. 6 is a diamgrammatical rear view of an alternate configuration of the upper flashboard elements of the flashboard box assembly of FIG. 4.

Referring to FIG. 5, when storm water inflow exceeds outflow over the discharge overflow edge 45 at a depth exceeding d, surface water will spill over the upper inlet overflow edge 37 of the inlet flashboard wall assembly into the flashboard box 18 for discharge with the bottom water. Selective variation of the relative levels of the discharge flashboard wall assembly and the inlet flashboard wall assembly permits variation of the ratio of bottom water and surface water discharged from the flashboard box 18. Selective variation of the relative levels and withdrawal ratios can be further enhanced by incorporating a v-notch spillway 43 in the uppermost flashboard element 41 of the inlet flashboard wall assembly 38. By setting the bottom of the v-notch 43 at the elevation of the upper edge 45 of the discharge wall assembly 42 as shown in FIG. 6, some surface water will always be part of the total discharge.

As can be seen, the discharge control assembly 10 provides automatic gravitational discharge of bottom water relative to the height of the surface of the lake and automatically removes bottom water at a varying rate which depends upon the spill-over levels of the discharge and inlet flashboard wall assemblies and the hydrologic conditions of the lake 12. Additionally, only infrequent manual adjustments are required to account for changes in the seasons, withdrawal rate is maximized for varying hydrologic conditions, and the lake level fluctuates only slightly.

Through the automatic controlled removal of bottom water, the growth of aquatic weeds and algae is controlled and the quality of water is improved. The removal of nutrient-rich bottom water not only removes a source of nutrients for the aquatic weeds and algae growth but results in a retardation of nutrient release from the bottom sediment and avoids the consequences of an anoxic bottom layer. The removal of oxygen-deficient bottom water causes the more oxygen-laden water from the upper levels to move downwardly. The presence of oxygen retards the release of nutrients as, for example, phosphorus from the bottom sediment. Accordingly, plant growth is controlled and the quality of water is improved.

Figure 7:
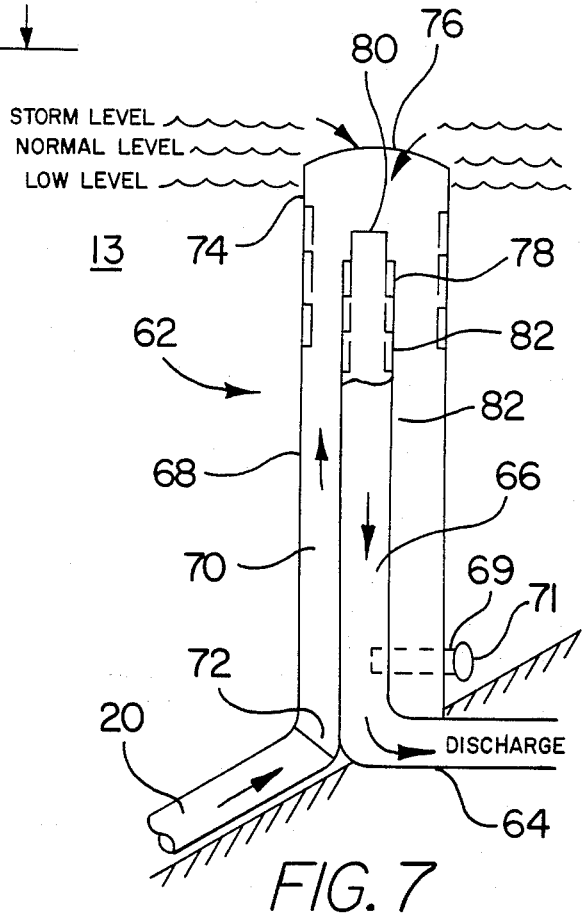
FIG. 7 is a partial diagrammatical sectional view of a second embodiment of the discharge control assembly of the present invention operationally mounted in a water body of the type having a deep subsurface outlet culvert.

Referring to FIG. 7, an alternate embodiment of the discharge control assembly of the present invention is shown and generally designated by the numeral 62. The control assembly 62 is adapted for utilization with a water body or lake 13 of the type having a deep subsurface outlet culvert 64 which extends laterally through the side edge 16 of the lake to connect the lake to the discharge drain 14.

The discharge control assembly 62 comprises an inner conduit 66 coaxially vertically disposed within an outer conduit 68 to form a reservoir space or receptacle 70 therebetween.

Figure 4:
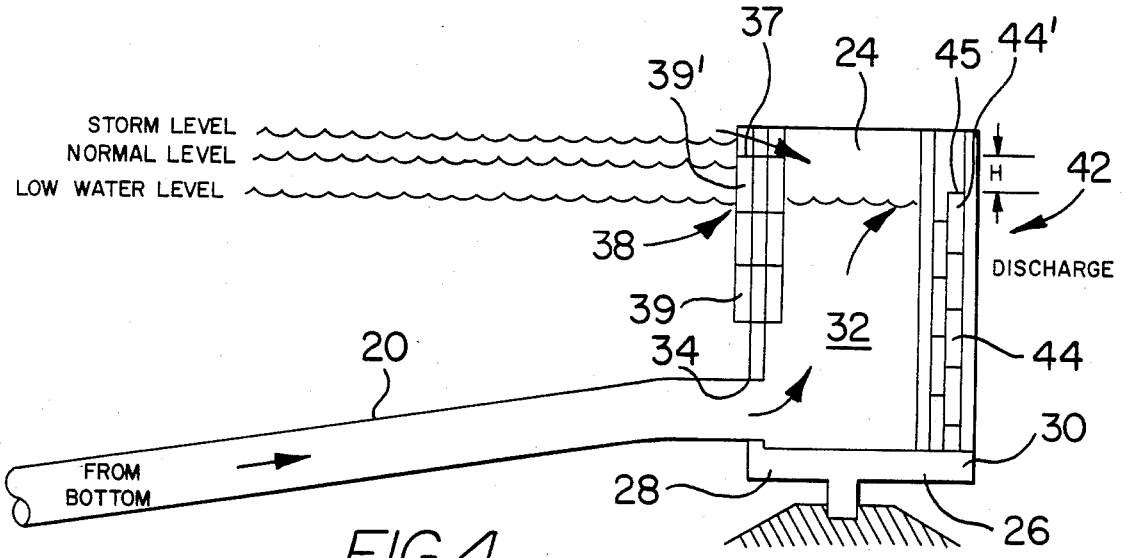
FIG. 4 is an enlarged diagrammatical sectional view of the flashboard box assembly shown in FIG. 1.

The outer conduit 68 has an inlet port 72 at its lower end connected to the bottom water conduit 20. The upper end 74 of the outer conduit 68 is open with a circumferential edge 76 providing a predetermined inlet spill-over level (similar to the inlet spill-over level 37 of the embodiment of FIG. 4) so that surface water of the lake above the predetermined inlet spill-over level 76 overflows into the outer conduit 68.

The inner conduit 66 is connected at its lower end to the outlet culvert 64. The upper end 78 of the inner conduit is open with a circumferential edge 80 providing a predetermined discharge spill-over level (similar to the discharge spill-over level 45 of the embodiment of FIG. 4) so that water within the receptacle 70 above the predetermined discharge spill-over level overflows into the inner conduit 66 and is discharged out the outlet culvert 64.

The upper end 78 of the inner conduit 66 is comprised of a plurality of detachable interlocking collar elements 82 for varying the vertical height of the overflow edge 80. Similarly, the upper end 74 of the outer conduit 68 may be comprised of similar collar elements 82 for varying the predetermined vertical height of the surface water inlet overflow edge 76. Selective adjustment of the relative vertical heights of the inner and outer conduits 66, 68 provides control of the rate of discharge from the discharge control assembly 62 as well as control of the ratio of bottom water and surface water discharged in a manner similar to the discharge control assembly 10. A capped pipe 69 extends through the outer conduit 68 and the inner conduit 66 at the deepest point and is adapted for removal of the cap 71 for interconnecting the conduits to the outlet culvert 64 to permit emptying of the lake as necessary.

Figure 3:
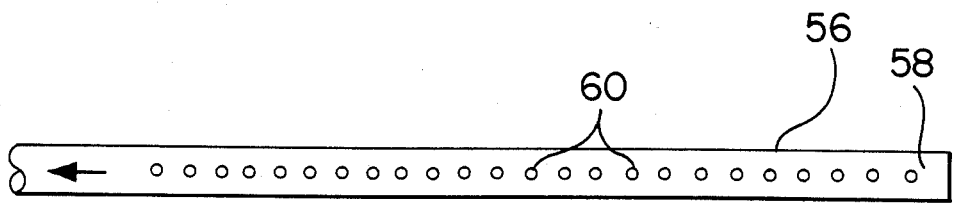
FIG. 3 is a diagrammatical view of an alternative bottom water collector for alternate use in the discharge control assembly of FIG. 1.

The bottom water conduit 20 is connected to a bottom water collector and, for water bodies which form an epilimnion, metalimnion and hypolimnion, the bottom water collector 22 shown in FIG. 1 may be utilized. Alternately, the bottom water collector 56 is utilized in shallow water bodies in accordance with the above-described explanation relative to the configurations of FIGS. 1 and 3.

In operation, the heights of the inner and outer conduits 66, 68 are set by the interlocking collar elements 82 to the desired inlet spill-over level and discharge spill-over level respectively in accordance with the system hydrology. The withdrawal of bottom water from the lake into the receptacle 70 for discharge through the inner conduit 66 and discharge culvert 64 is controlled by the effective head of the control assembly 62 and increases automatically as the lake level rises. The operation of control assembly 62 is similar to control assembly 10 and provides automatic gravitational discharge of bottom water relative to the height of the lake surface. Bottom water is automatically removed at a varying rate which depends upon the spill-over levels of the inner and outer conduits 66, 68 and the hydrologic conditions of the lake 13. Accordingly, the growth of aquatic weeds and algae is controlled and the quality of water is improved.

Figure 8:
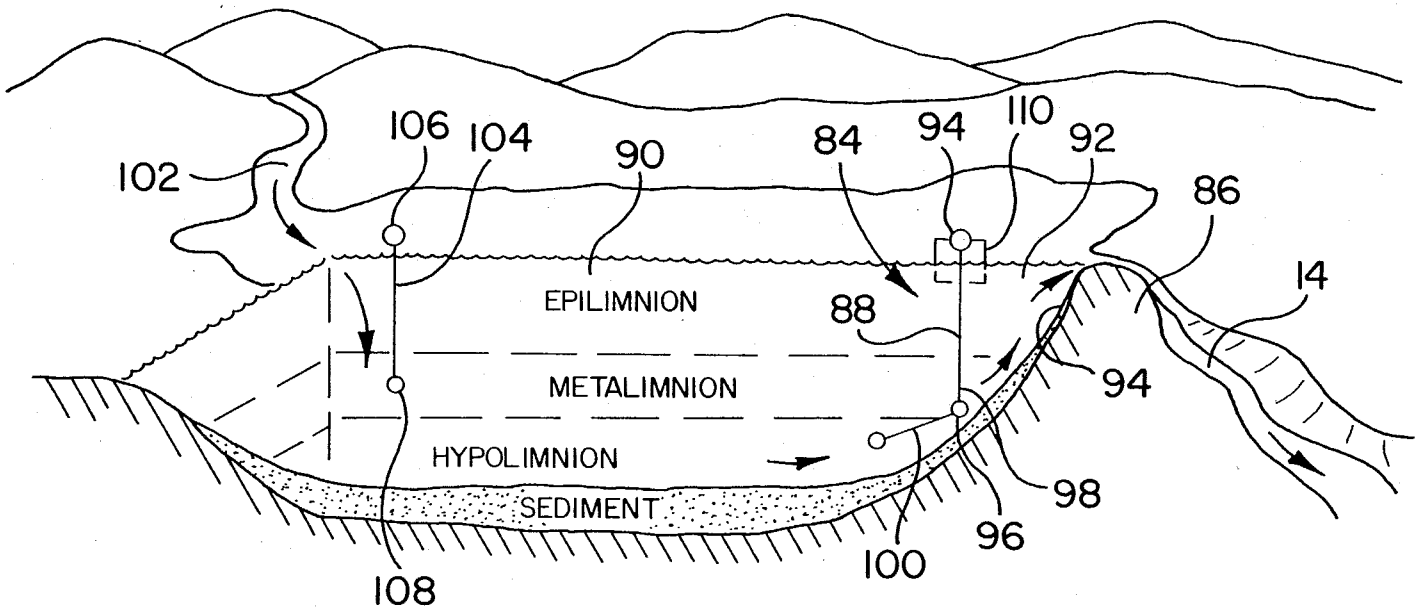
FIG. 8 is a diagrammatical view of a third embodiment of the discharge control assembly of the present invention operationally mounted in a water body of the type having a primary inflow tributary.

Referring to FIG. 8, a third embodiment of the discharge control assembly of the present invention is shown and generally designated by the numeral 84. The control assembly 84 is adapted for utilization with a body of water, such as lake 90, having an inlet stream 102, an outlet stream 14 and an overflow spillway area 86.

The control assembly 84 comprises a curtain partition 88 across the outlet end of the lake 90 to form a receptacle area 92 together with the side wall 94 of the lake. The curtain partition 88 is suspended vertically by a plurality of floats 94 at its upper end and has a plurality of weights 96 at the lower end. The curtain partition 88 is suspended to a predetermined depth sufficient to force the outflow of water from the lake from the bottom cold-water layer, i.e., bottom water. The distance between the lower end 98 of the curtain partition 88 and the floor of the lake in effect forms an opening to the receptacle portion 92 to receive bottom water. Preferably, the volume of the receptacle portion 92 is predetermined to yield a residence time greater than three days based on the mean annual flow of the lake. In lakes where the deep layer or hypolimnion is not proximal to the outlet stream, an extension tunnel 100 is connected to the lower end 98 of the vertical curtain partition 88 to facilitate withdrawal of bottom water. The extension tunnel 100 may be provided by a second curtain angled inwardly and downwardly from the lower edge of the vertical curtain 88 as diagrammatically shown in FIG. 8. A spillway system 110 similar to the inlet flashboard wall assembly 38 may be incorporated into the floatation discharge control assembly 84 as shown diagrammatically in broken line in FIG. 8 to attain a mixture of surface and bottom water outflow.

In lakes where much of the inflow is from primary tributaries, such as the inlet stream 102, a thermal curtain partition 104 may be suspended across the inlet ends of the lake to force cool inflow water to the deep layer of the lake, (i.e., enhance interflow). The curtain or partition 104 is suspended by floats 106 and held vertically by the weights 108. The volume of water on the inflow side of the curtain partition 104 is minimized in order to avoid warming effects on the water inflowing into the deep layer. Alternately, a separate inlet collecting reservoir (not shown) and conduit (not shown) leading to the bottom of the lake may be utilized to enhance interflow. The enhanced interflow accordingly introduces watershed inputs of cool oxygen-rich water to the deep, cool layer and avoids direct watershed input of nutrients to the warm productive surface layer to thereby facilitate the control of aquatic weed and algae growth and enhance water quality.

Accordingly, an apparatus and method for controlling the growth of aquatic macrophytes and algae is provided which alters the outflow configuration of the water body for controlled discharge of bottom water as well as surface water. The cool oxygen-deficient nutrient-rich bottom water is removed from the water body at a rate which automatically adjusts to varying hydrologic conditions without the need for pumping, siphoning, frequent adjustments, or large fluctuations in water level. Additionally, adjustable surface-bottom water outflow ratios are attained.

I claim:

1. A hydrologic discharge control assembly for automatically withdrawing bottom water from a body of water having a top surface, a bottom water portion, and a discharge drain passageway comprising a flashboard box having opposing side walls and a bottom wall forming a reservoir for receiving bottom water from said body of water and for discharging water into said drain passageway, said reservoir having a vertically disposed discharge slot for overflow discharge of water from said reservoir into the discharge drain passageway when the water within the reservoir exceeds a predetermined level, a reservoir inlet port adjacent said bottom wall for fluidly connecting said reservoir to the bottom water portion of the body of water, a discharge flashboard wall assembly having an upper discharge overflow edge portion defining a predetemrined spill-over level and being mounted to close a portion of said discharge slot so that water contained within said reservoir above said predetermined spill-over level spills outwardly over said overflow edge portion, a conduit with an outlet end connected to said reservoir inlet port and an inlet end adapted for disposition in the bottom water portion of the body of water for conducting said bottom water to said reservoir, said flashboard box being adapted for disposition within said body of water and having a vertically disposed surface water inlet slot for receiving surface water from said body of water into said reservoir, an inlet flashboard wall assembly having an upper overflow edge portion and being mounted to close a portion of said inlet slot so that the surface water of the body of water above a predetermined vertical level spills inwardly over said upper overflow edge portion, said flashboard box being mountable to define a vertical differential between the predetermined spill-over level and the top surface of the body of water whereby the differential water level between the body of the water and the predetermined level in the reservoir drives the water in said bottom water portion through said inlet port into said reservoir for automatic discharge over said flashboard wall assembly into the discharge drain passageway.

2. The device of claim 1 which comprises means for varying said predetermined vertical level.

3. The device of claim 1 wherein said inlet flashboard wall assembly is vertically adjustable for varying the vertical height of said overflow edge portion.

4. The device of claim 5 wherein said flashboard assembly comprises a plurality of detachable interlocking board elements selectively mountable within said inlet slot of said flashboard box.

5. The device of claim 1 wherein said discharge flashboard assembly includes means for varying the predetermined spill-over level and said inlet flashboard assembly includes means for varying said predetermined vertical level to control the ratio of bottom water and surface water discharged from said flashboard box.

6. The device of claim 1 wherein said discharge flashboard assembly includes means for varying said predetermined spill-over level and said inlet flashboard assembly includes means for varying said predetermined vertical level, said predetermined spill-over level and said predetermined vertical level being selectively adjustable to control the discharge of bottom water.

7. In a body of water having a top surface, a floor, a bottom water portion adjacent the floor, and an outlet end with an overflow spillway, a hydrologic discharge control assembly comprising curtain partition means extending across the outlet end of the body of water in spaced disposition from the spillway to form a reservoir separated from the remaining portion of the body of water, said curtain partition means extending vertically from adjacent the surface of the body of water to a predetermined level at said bottom water portion and above the floor of the body of water to form an inlet to the reservoir from said remaining portion of the body of water whereby the outflow of water from the reservoir at said overflow spillway draws water from said bottom water portion through said inlet into said reservoir.

8. The device of claim 7 wherein said curtain partition means comprises a curtain element supported by a plurality of floats at its upper end and being weighted at its lower end to maintain a vertical disposition in the body of water.

9. The device of claim 7 comprising means for connecting the inlet to the bottom water portion of a body of water.

10. The device of claim 7 wherein said curtain partition means is dimensioned and configured to form a reservoir of predetermined volume relative to the mean annual flow of the body of water.

11. The device of claim 7 for use with a body of water which receives a substantial amount of its inflow from primary tributaries at its inlet end further comprising a second curtain partition means for extending across the inlet ends of the body of water in spaced disposition from the primary tributary, said second curtain partition means adapted to extend vertically from the surface to a predetermined level above the floor of the body of water to form an outlet to the bottom water portion of the body of water.

12. In a body of water of the type which receives a substantial amount of inflow from a primary tributary and having a top surface, a floor, a deep water layer adjacent the floor, an inflow inlet end adjacent said tributary, and an overflow outlet end, a hydrologic control assembly comprising a curtain partition means extending across the inlet end of the body of water in spaced disposition from the primary tributary to form an inlet reservoir separated from the remaining portion of the body of water, said curtain partition means extending vertically from adjacent the surface of the body of water to a predetermined level adjacent said deep water layer and above the floor of the body of water to form an outlet passage from the inlet reservoir to said remaining portion of the body of water, said outlet passage being fluidly connected to the deep water layer so that water from said inlet reservoir is drawn through said outlet passage of said curtain partition means into said deep water layer responsive to the outflow of water from said body of water at said overflow outlet end.

13. The device of claim 12 wherein said curtain partition means comprises a curtain element supported by a plurality of floats at its upper end and being weighted at its lower end to maintain a vertical disposition in the body of water.

14. A hydrologic discharge control assembly for automatically withdrawing bottom water from a body of water having a top surface, a bottom water portion, and a discharge drain passageway having a subsurface outlet culvert extending generally laterally outwardly from the body of water comprising an outer conduit and an inner conduit vertically disposed within said outer conduit so that the space between said inner and outer conduits forms a reservoir to receive bottom water from said body of water, said inner conduit having an open upper end with a circumferential edge and a lower end adapted for connection to said subsurface outlet culvert, said circumferential edge providing a discharge overflow edge at a predetermined vertical level to define a predetermined spill-over level, said outer conduit having an open upper end with a circumferential edge at a predetermined vertical level forming a surface water inlet overflow edge portion so that the surface water of the body of water above the predetermined vertical level spills into said outer conduit over said overflow edge portion, means for varying said predetermined vertical level of said inlet overflow edge portion, reservoir inlet means for fluidly connecting said reservoir to the bottom water portion of the body of water for conducting said bottom water into said reservoir whereby the differential water level between the body of the water and the predetermined level in the reservoir drives the water in said bottom water portion through said inlet means into said reservoir for automatic discharge over said overflow means into the discharge drain passageway.

15. A hydrologic discharge control assembly for automatically withdrawing bottom water from a body of water having a top surface, a bottom water portion, and a discharge drain passageway having a subsurface outlet culvert extending generally laterally outwardly from the body of water comprising an outer conduit and an inner conduit vertically disposed within said outer conduit so that the space between said inner and outer conduits forms a reservoir to receive bottom water from said body of water, said inner conduit having an open upper end with a circumferential edge and a lower end adapted for connection to said subsurface outlet culvert, said circumferential edge providing a discharge overflow edge at a predetermined vertical level to define a predetermined spill-over level, said outer conduit having an open upper end with a circumferential edge at a predetermined vertical level forming a surface water inlet overflow edge portion so that the surface water of the body of water above the predetermined vertical level spills into said outer conduit over said overflow edge portion, said outer conduit comprising a plurality of detachable interlocking collar elements for varying the vertical level of said circumferential edge, reservoir inlet means for fluidly connecting said reservoir to the bottom water portion of the body of water for the conducting said bottom water into said reservoir whereby the differential water level between the body of the water and the predetermined level in the reservoir drives the water in said bottom water portion through said inlet means into said reservoir for automatic discharge over said overflow means into the discharge drain passageway.

16. A hydrologic discharge control assembly for automatically withdrawing bottom water from a body of water having a top surface, a bottom water portion, and a discharge drain passageway having a subsurface outlet culvert extending generally laterally outwardly from the body of water comprising an outer conduit and an inner conduit vertically disposed within said outer conduit so that the space between said inner and outer conduits forms a reservoir to receive bottom water from said body of water, said inner conduit having an open upper end with a circumferential edge and a lower end adapted for connection to said subsurface outlet culvert, said circumferential edge providing a discharge overflow edge at a predetermined vertical level to define a predetermined spill-over level, said outer conduit having an open upper end with a circumferential edge at a predetermined vertical level forming a surface water inlet overflow edge portion so that the surface water of the body of water above the surface water inlet spills into said outer conduit over said overflow edge portion, reservoir inlet means for fluidly connecting said reservoir to the bottom water portion of the body of water for the conducting said bottom water into said reservoir whereby the differential water level between the body of the water and the predetermined level in the reservoir drives the water in said bottom water portion through said inlet means into said reservoir for automatic discharge over said overflow means into the discharge drain passageway, means for selectively varying said predetermined vertical level of said discharge overflow edge of said inner conduit and said predetermined vertical level of said inlet overflow edge portion of said outer conduit to control the ratio of bottom water and surface water discharge from said reservoir.

17. The device of claim 16 wherein said predetermined vertical level of said discharge overflow edge and said predetermined vertical level of said inlet overflow edge portion each are selectively adjustable to control the discharge of bottom water.

* * * * *